US007347727B2

(12) United States Patent
Wlos et al.

(10) Patent No.: US 7,347,727 B2
(45) **Date of Patent: *Mar. 25, 2008**

(54) PUSH-ON CONNECTOR INTERFACE

(75) Inventors: James Wlos, Crete, IL (US); Jeffrey Paynter, Momence, IL (US)

(73) Assignee: Andrew Corporation, West Chester, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/709,364

(22) Filed: Apr. 29, 2004

(65) Prior Publication Data

US 2005/0164552 A1 Jul. 28, 2005

Related U.S. Application Data

(63) Continuation-in-part of application No. 10/707,912, filed on Jan. 23, 2004.

(51) Int. Cl.
*H01R 9/05* (2006.01)

(52) U.S. Cl. ..... 439/578

(58) Field of Classification Search ..... 439/578–586, 439/675, 63

See application file for complete search history.

(56) References Cited

U.S. PATENT DOCUMENTS 3,281,756 A 10/1966 O'Keefe et al.
3,739,076 A * 6/1973 Schwartz ..... 174/78
4,046,451 A 9/1977 Juds et al.
4,355,857 A 10/1982 Hayward
4,915,651 A * 4/1990 Bout ..... 439/578
4,941,846 A * 7/1990 Guimond et al. ..... 439/578
4,963,105 A * 10/1990 Lewis et al. ..... 439/578
5,074,809 A 12/1991 Rousseau
5,454,735 A * 10/1995 Nelson ..... 439/578
5,486,123 A 1/1996 Miyazaki
5,556,292 A 9/1996 Kato et al.
5,562,506 A 10/1996 Wright
5,595,499 A 1/1997 Zander et al.
5,795,188 A * 8/1998 Harwath ..... 439/583
6,024,609 A 2/2000 Kooiman et al.
6,149,448 A 11/2000 Haller et al.
6,174,206 B1 1/2001 Yentile et al.
6,210,221 B1 * 4/2001 Maury ..... 439/578
6,267,612 B1 * 7/2001 Arcykiewicz et al. ..... 439/253
6,361,348 B1 3/2002 Hall et al.
6,450,829 B1 9/2002 Weisz-Margulescu
6,568,964 B2 * 5/2003 D'Addario ..... 439/675
6,650,209 B2 * 11/2003 Plummer et al. ..... 333/245

(Continued)

*Primary Examiner*—Edwin A. Leon
(74) *Attorney, Agent, or Firm*—Babcock IP, PLLC

(57) ABSTRACT

A push-on connector interface and associated spring ring adapted for use with, for example, existing standardized threaded female connectors, for example SMA or Type N connectors. A plurality of spring fingers of the male connector body engage the, typically threaded, outer diameter surface of the female connector body. A sleeve within the male connector body may be adapted to extend within a bore of the female connector body. A spring or spring ring located, for example, positioned within a groove or press-fit upon the sleeve has a plurality of deflectable protrusions which deform between the sleeve and an inner diameter surface of the bore and or are biased against the inner diameter surface. The connections formed by the bias of spring fingers and the deformation and or bias of the spring or spring ring creating a reliable mechanical and electrical interconnection between the male and female connector bodies.

25 Claims, 9 Drawing Sheets

U.S. PATENT DOCUMENTS 6,695,636 B2 * 2/2004 Hall et al. ..... 439/352
6,793,529 B1 * 9/2004 Buenz ..... 439/583
6,824,415 B2 * 11/2004 Wlos ..... 439/348

* cited by examiner

PUSH-ON CONNECTOR INTERFACE

CROSS REFERENCE TO RELATED APPLICATIONS

This is a continuation-in-part of application Ser. No. 10/707,912, filed Jan. 23, 2004.

BACKGROUND OF INVENTION

1. Field of the Invention

The invention relates to a push-on electrical connector interface. More particularly the invention relates to a push-on coaxial connector interface for use with both modified and standard connector interfaces adapted for interconnection via a threaded coupling nut.

2. Description of Related Art

Electrical connectors used in RF applications have become standardized to allow interoperability of equipment from different manufacturers. Examples of standard connector types include: SMA, Type N, BNC and Type F (CATV) connectors. Male Type F connectors include a threaded collar which mates to threads on the female interface to retain the interconnection. Alternatively, Male Type F connectors are available with spring fingers which form an interference fit when pushed over the threaded portion of a female Type F receptacle. Type F connectors using spring fingers are of suspect reliability because the retention of the connector relies upon the interference fit between the spring fingers and the female receptacle, the form of the interference fit having been adapted in a compromise between ease of insertion and retention. The high frequency electrical characteristics of the interconnection formed with the outer conductor may be less than satisfactory because of the absence of an electrical connection at areas between each of the spring fingers.

BNC connectors include radially projecting pins on the female portion which mate with slots in a spring biased male portion outer collar when the connectors are inserted together and the outer collar rotated, allowing a quick interconnection without use of tools. However, the comparatively complex BNC connector is significantly more expensive to manufacture than Type F. Both BNC and Type F connectors are typically used in low signal level and or inexpensive consumer applications.

Standardized connectors for higher power levels, such as SMA and Type N, use a threaded outer collar in the male portion which mates with threads formed in the outer diameter of the female portion.

The threaded outer collar requires multiple turns to fully seat the interconnection, consuming time and forcing the user to use both hands and or a wrench. Where connections are frequently changed, such as at a patch panel or with testing equipment, screwing and unscrewing the threaded outer collar becomes a burden.

Competition within the electrical connector industry has focused attention upon ease of use, electrical interconnection characteristics and connector reliability. Factors of commercial success also include reduction of manufacturing, materials and installation costs.

Therefore, it is an object of the invention to provide a connector interface that overcomes deficiencies in such prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The invention is described with respect to FIGS. 1-10 in a standard SMA female connector configuration. One skilled in the art will appreciate that the invention is similarly applicable to Type N connectors and or other standard or proprietary connector configurations having an end bore which allows an outer diameter surface of the female portion to be contacted also upon an inner diameter surface.

As shown in FIGS. 1-5, a standard SMA female connector body 1, shown here adapted for panel face mounting, has threads 3 on an outer diameter surface. Normally, the threads 3 are engaged by a rotatable outer threaded collar of an SMA male connector body. A male connector body 5, according to a first exemplary embodiment of the invention, contacts the threads 3 with a plurality of outer spring finger(s) 7 spaced around a front end of the male connector body 5.

Figure 1:
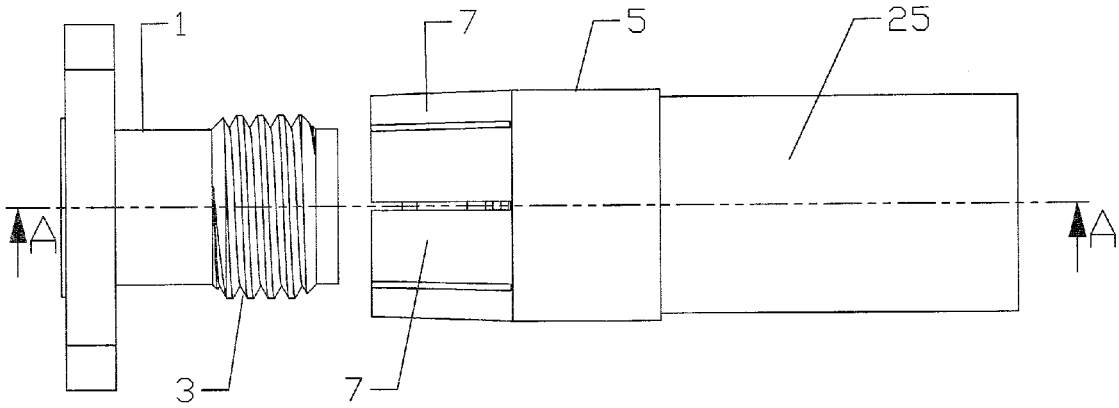
FIG. 1 is an external side view of a first embodiment of the invention, prior to interconnection.

The outer spring finger(s) 7 are adapted to form an interference fit over and against the threads 3 when the male connector body 5 is inserted along a longitudinal axis, demonstrated by section line A-A of FIG. 1, of the female connector body 1. A leading edge of each outer spring finger 7 may be formed with an angled face 9 to guide the initial centering of the male connector body 5 upon the female connector body 1, prior to push-on interconnection. The plurality of outer spring finger(s) 7 each co-operate together to create a secure mechanical and electrical interconnection between the female connector body 1 and the male connector body 5. To provide for outer spring fingers with an acceptable spring characteristic, strength and resilience, the male connector body may be formed from a metal alloy such as phosphor-bronze.

Figure 2:
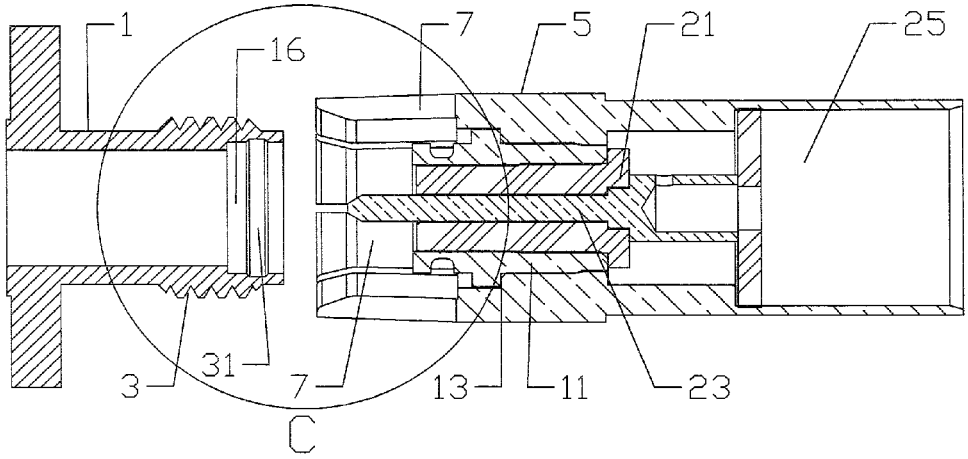
FIG. 2 is a cross sectional view of FIG. 1, along line A-A, prior to interconnection.

A sleeve 11 may be dimensioned for press-fitting into a bore of the male connector body 5, to seat against a shoulder 13 (FIG. 2). A front end portion of the sleeve 11 is dimensioned to fit within an inside diameter of a bore 16 formed in a leading edge of the female connector body 1. The leading edge 15 of the sleeve 11 is the surface which the female connector body 1 bottoms against when the male connector body 5 is fully pushed against the female connector body 1.

Figure 3:
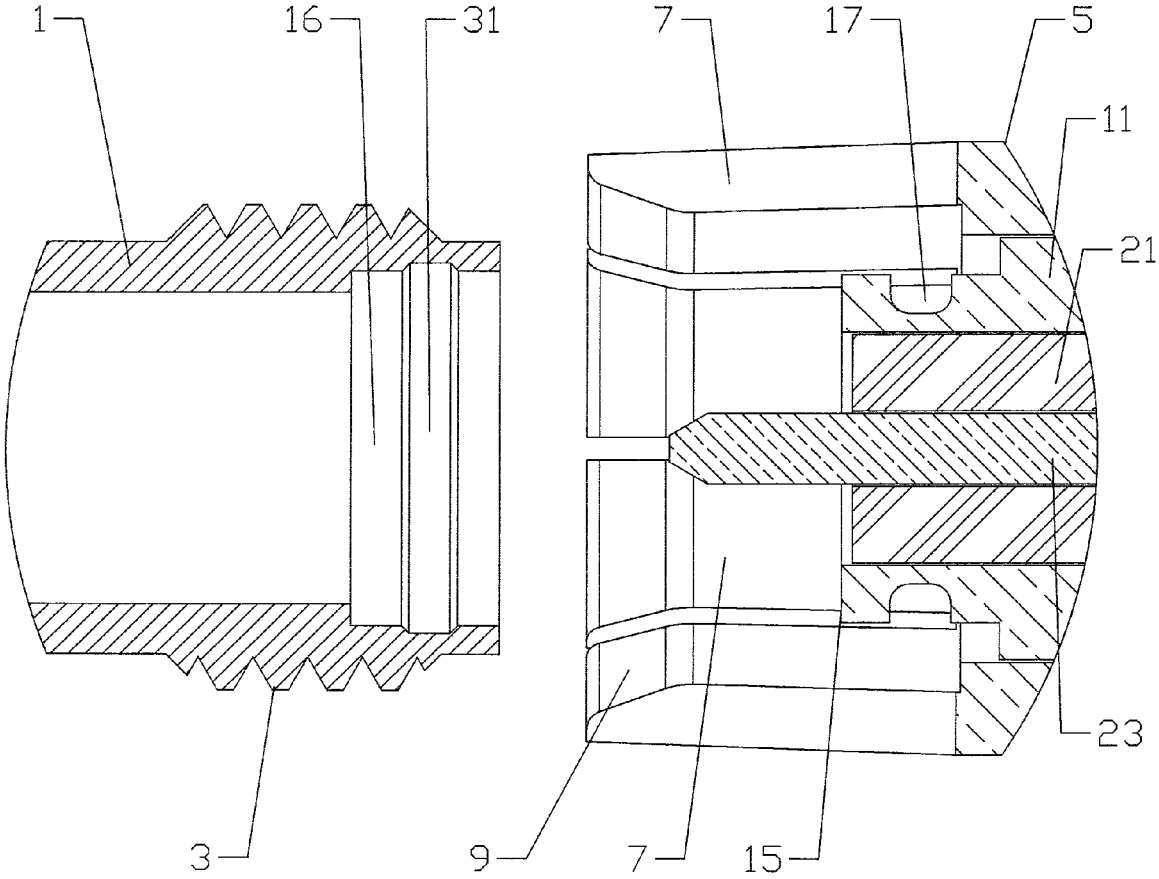
FIG. 3 is a close up view of area C from FIG. 2.
Figure 4:
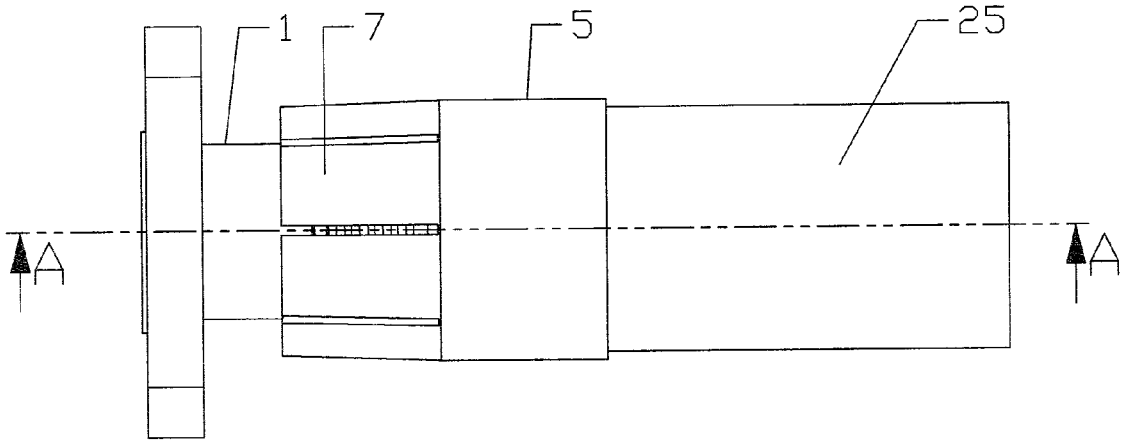
FIG. 4 is an external side view of a first embodiment of the invention, interconnected.
Figure 5:
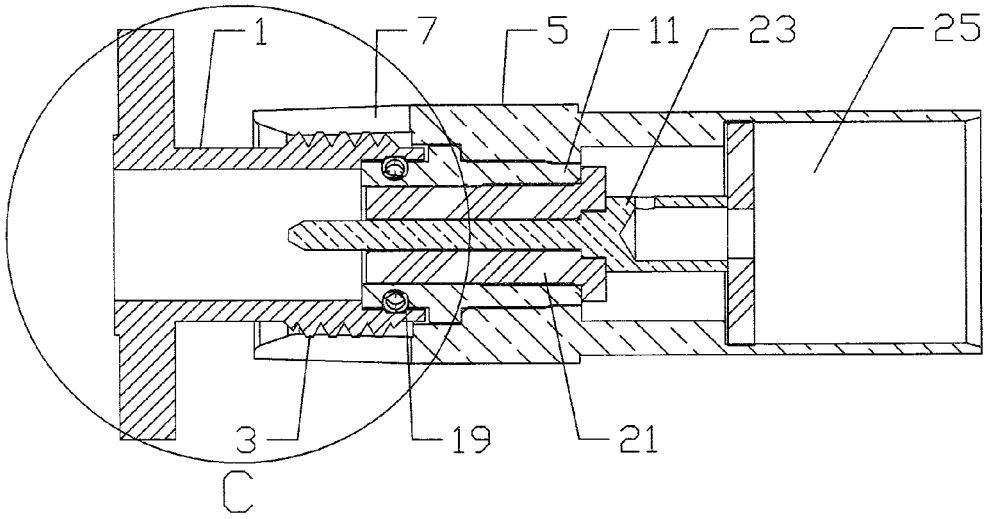
FIG. 5 is a cross sectional view of FIG. 1, along line A-A, interconnected.
Figure 6:
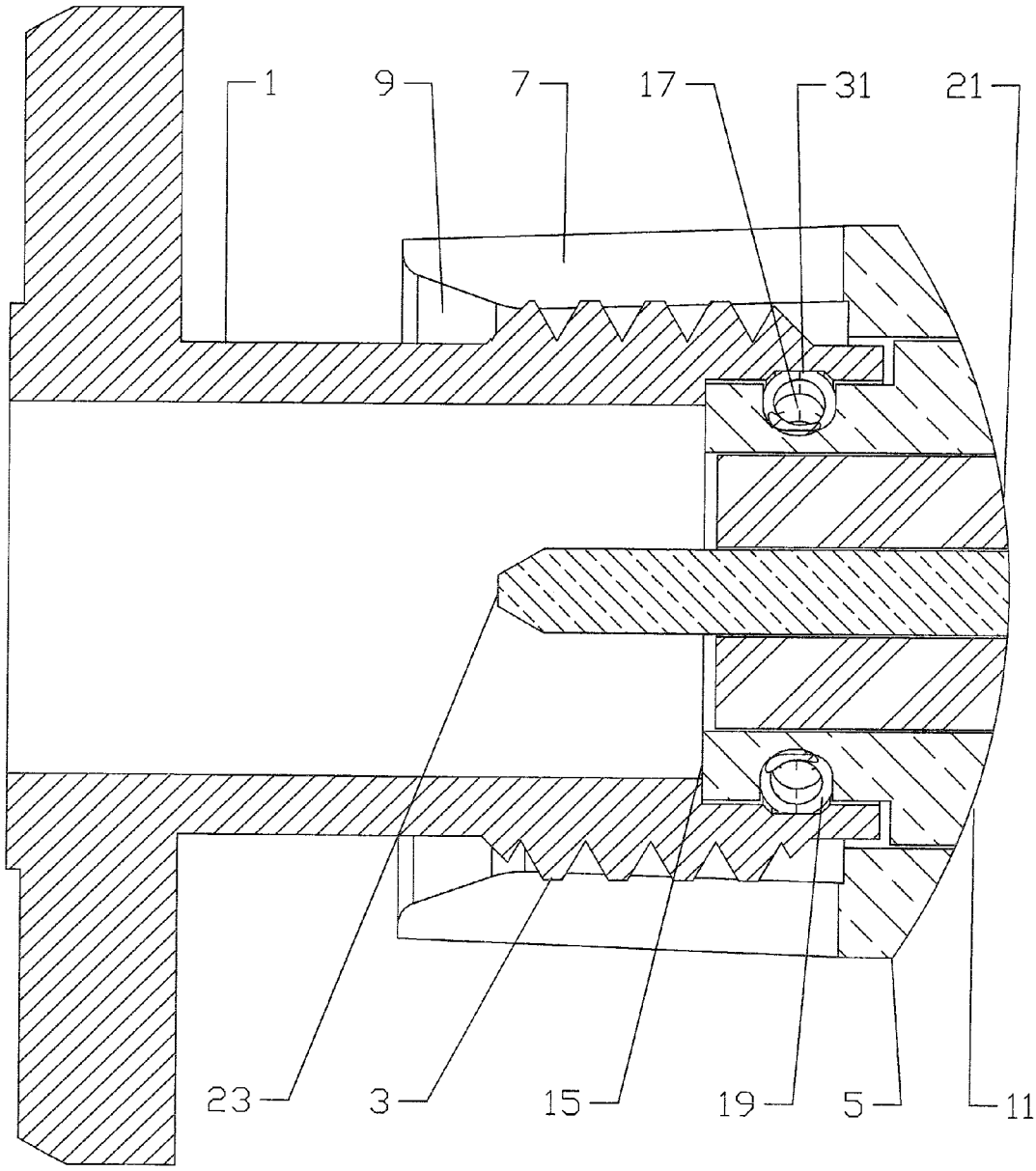
FIG. 6 is a close up view of area C from FIG. 5.

As shown in FIG. 3, a first groove 17 formed in an outer diameter of the front end portion of the sleeve 11 is adapted to seat a first spring 19 (FIGS. 5 and 6). The first spring 19 is dimensioned to be compressed between the inside diameter of the female connector body 1 bore 16 and the sleeve 11, creating an additional mechanical and electrical interconnection between the female connector body 1 and the male connector body 5. The first spring 19 may be, for example, a canted coil spring as shown, for example, in FIGS. 7 and 8 or other form of spring formed from a conductive material, such as a plurality of spring fingers projecting from a ring as described in the third exemplary embodiment, herein below.

An insulator 21 positions an inner conductor contact 23 coaxially within the sleeve 11. The inner conductor contact 23 is adapted to interact with the standard inner conductor interface of the female conductor body 1, omitted here for clarity. Further, a cable end of the male connector body 5 has a coaxial cable attachment area 25 adapted to receive and secure the inner and outer conductors of a coaxial cable into mechanical and electrical interconnection with the inner conductor contact 23 and the male connector body 5, respectively. Specific adaptations for interfacing with the coaxial cable outer and inner conductors via, for example conductive adhesive, soldering, crimping and or mechanical compression, depend upon the type of coaxial cable interfaced with and whether a factory or field and permanent or removable interconnection is desired. These various means are well known to one skilled in the art and therefore are not disclosed with further detail herein.

In use, a male connector body 5, already attached to a coaxial cable, is centered upon an existing standard female connector body 1 and pushed into place. As the male connector body 5 is pushed upon the female connector body 1 the plurality of outer spring finger(s) 7 are spread over the threads 3 creating a secure contact around the outer diameter surface of the female connector body between the outer spring finger(s) 7 and the threads 3. As the male connector body 5 continues along the female connector body 1, the leading edge 15 of the sleeve 11 is inserted within the inside diameter of the bore 16. The first spring 19 carried in first groove 17 is deformed between the first groove 17 and the inside diameter of the female connector body 1 bore 16, creating a second secure contact between the female connector body 1 and the male connector body 5.

Figure 7:
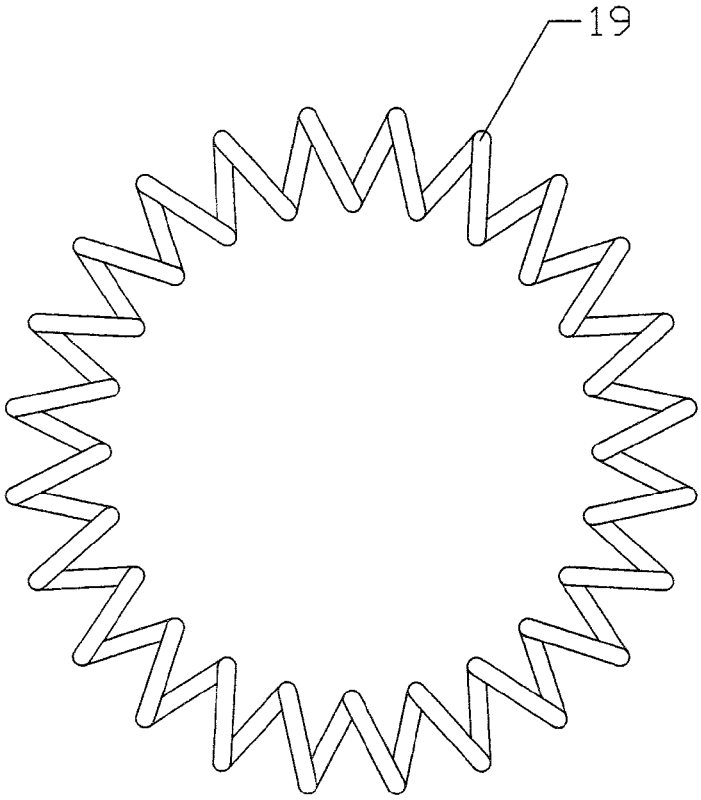
FIG. 7 is front view of a canted coil spring.
Figure 8:
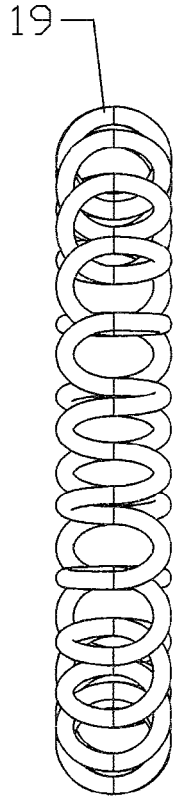
FIG. 8 is a side view of the canted coil spring of FIG. 7.
Figure 9:
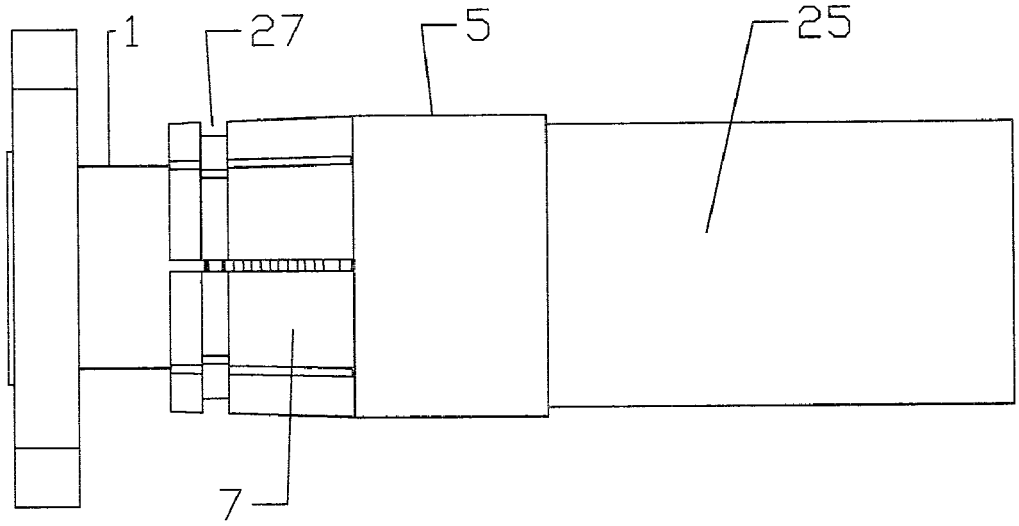
FIG. 9 is an external side view of a second embodiment of the invention.
Figure 10:
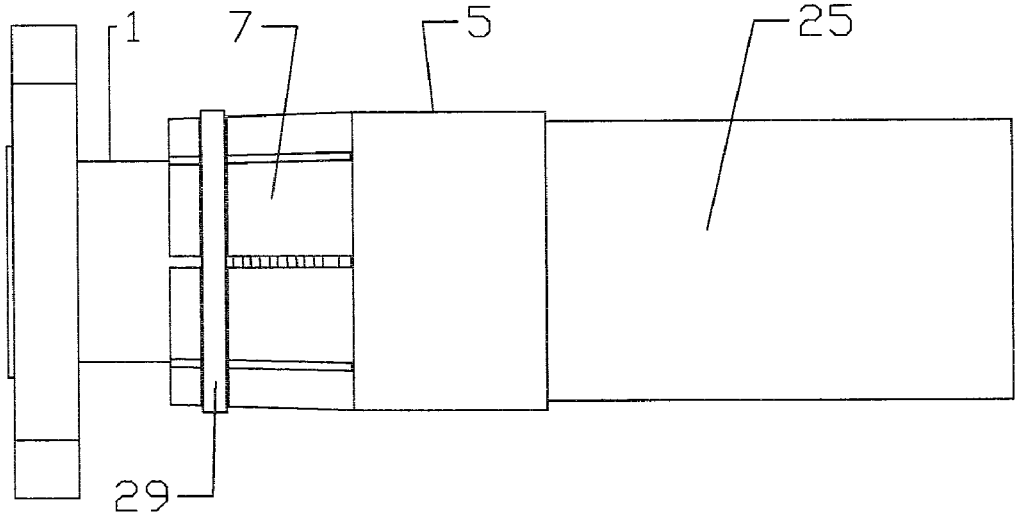
FIG. 10 is an external side view of the second embodiment of the invention, with a spring clip attached.
Figure 11:
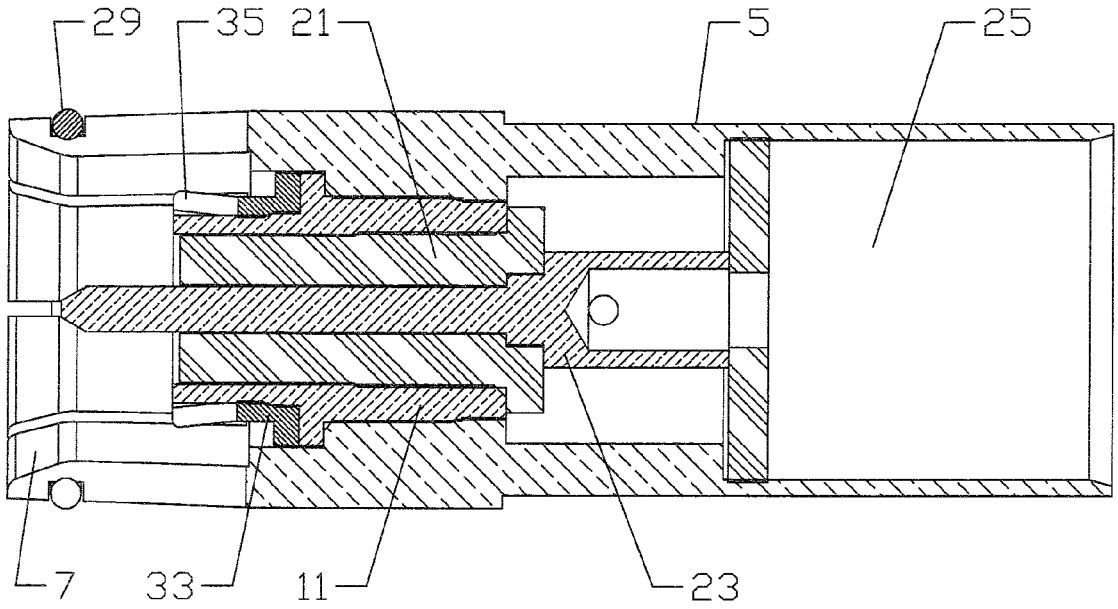
FIG. 11 is a cross sectional view of a third embodiment of the invention, along line A-A of FIG. 12, with a spring clip attached.
Figure 12:
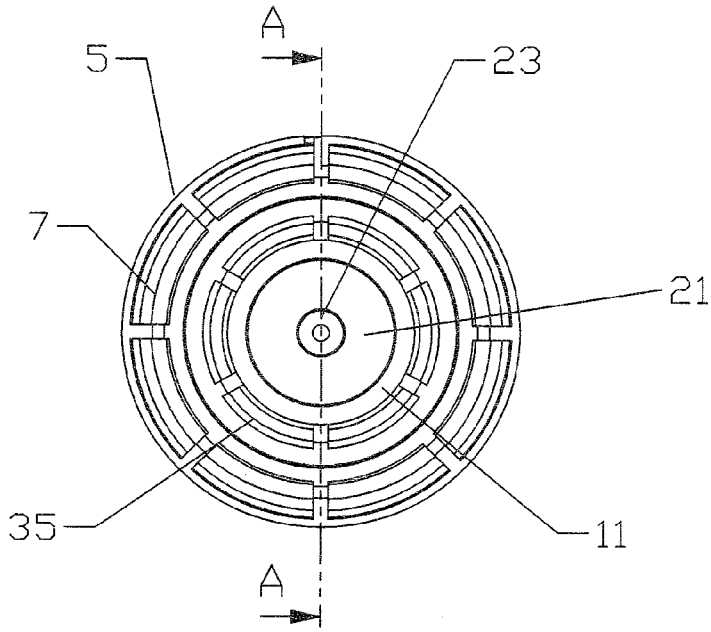
FIG. 12 is an end view of the third embodiment of the invention.

In a second exemplary embodiment, as shown in FIGS. 9 and 10, a second groove 27 may be added to an outer surface of the outer spring finger(s) 7 as a seating surface for a second spring 29. The second spring 29 further biasing the outer spring finger(s) 7 into contact with the threads 3. The second spring 29 may also be a canted coil spring, as shown in FIGS. 7 and 8. Alternatively, the second spring 29 may be replaced with an inward biased spring clip (FIG. 10) or a wire tie that may be attached after the male connector body 5 is seated upon the female connector body 1, thereby securing the interconnection against separation.

If a third groove 31 is formed in the inside diameter surface of the female connector body 1, configured to receive an inner diameter contacting portion of the first spring 19 and or align with the first groove 17 when the male connector body 5 is fully seated upon the female connector body 1, a detent function which operates by retaining the first spring 19 is created. The detent function creating a "click" feedback to the user that the interconnection has been made. When the third groove 31 is added to a standardized connector design, the resulting connector is operable with either the standardized threaded connectors or with the push-on connector and "click" interconnection feedback according to the invention.

A third exemplary embodiment of the invention, as shown in FIGS. 11-15 with corresponding element notations as described above, applies a spring finger collar 33 as the first spring 19. The spring finger collar 33 is dimensioned to press fit upon the outer diameter of the connector end of the sleeve 11, creating a strong electro-mechanical interconnection and eliminating the need for machining operations related to forming the first groove 17. Alternatively, the spring finger collar 33 may be adapted to press fit against the inner diameter of the male connector body 5. In this configuration, the spring finger(s) 35 are formed to extend away from the male connector body 5, around the leading edge of the female connector body 1 to contact and bias against the inner diameter of the female connector body 1 bore 16.

Figure 13:
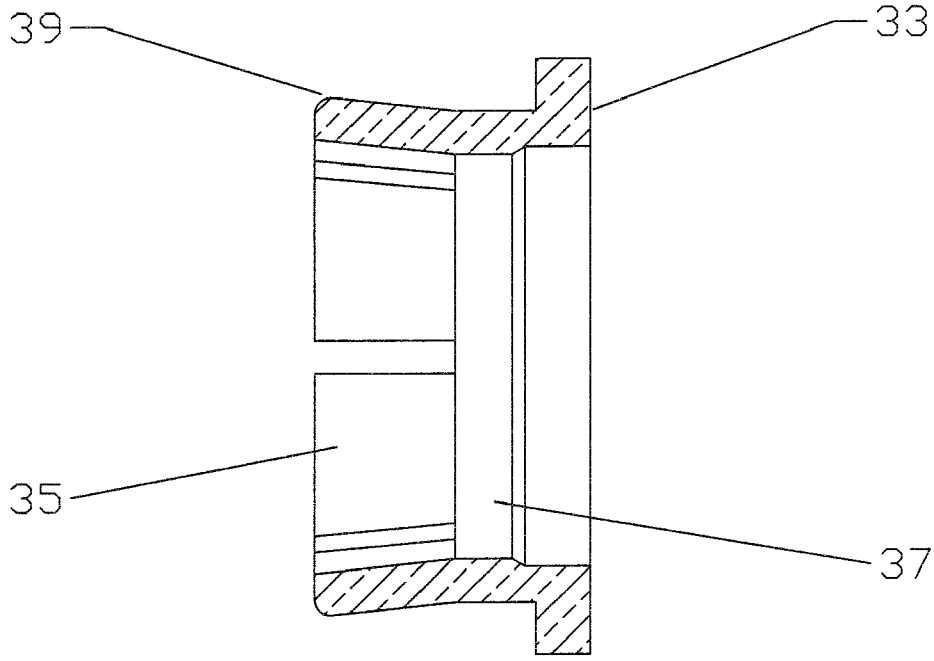
FIG. 13 is a cross sectional view of a spring finger ring, according to the third embodiment of the invention.
Figure 14:
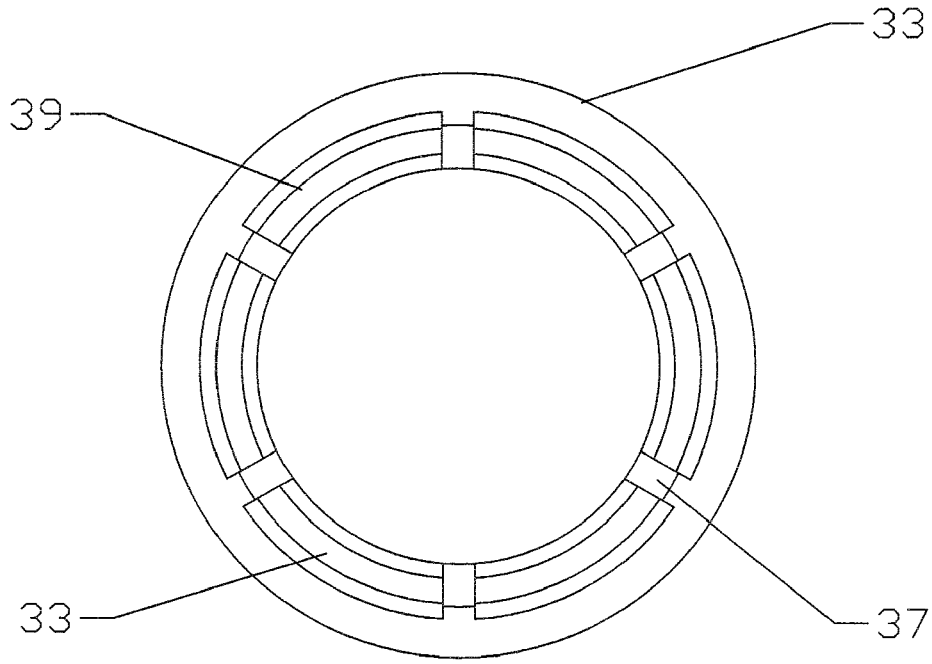
FIG. 14 is an end view of the spring finger ring shown in FIG. 13.
Figure 15:
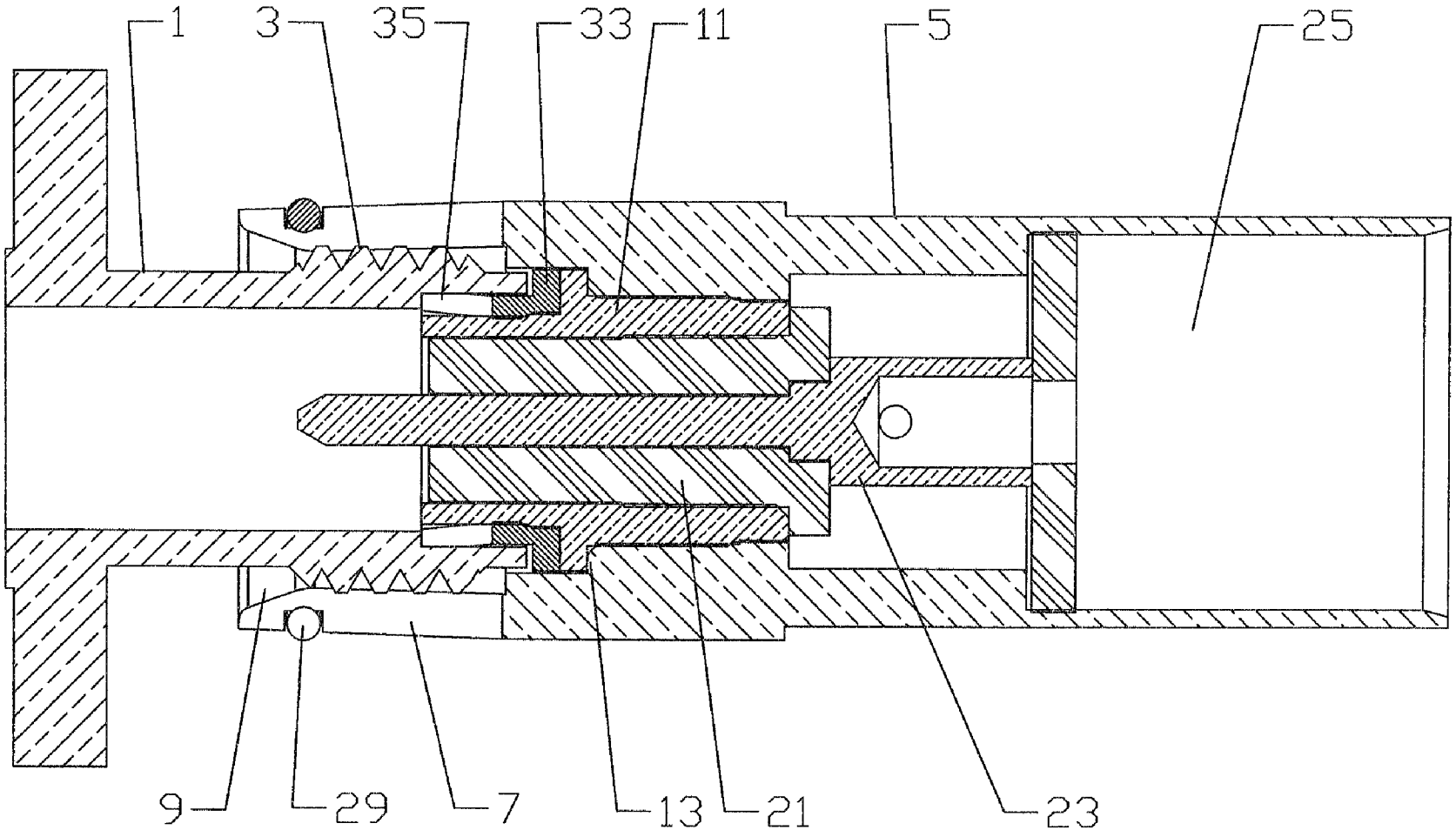
FIG. 15 is a cross sectional view of the third embodiment of the invention, mated to a female connector body, with a spring clip attached.

As shown in FIGS. 13 and 14, the spring finger ring 33 has a plurality of outwardly projecting deflectable protrusions, here in the form of spring finger(s) 35 projecting from a cylindrical collar 37. A leading edge 39 of each spring finger 35 may be formed with an angled surface and or a smooth radius to reduce friction as the spring finger(s) 35 initially contact and deflect against the inner diameter of the bore 16 during female connector body 1 to male connector body 5 mating. The deflection of each spring finger 35 creates a strong bias against the inner diameter of the bore 16, resulting in a secure electrical interconnection between the female connector body 1 and male connector body 5 as shown in FIG. 15.

The present embodiment demonstrates spring finger(s) 35 formed parallel with the longitudinal axis of the male connector body 5. Alternatively, the spring finger(s) may be formed at other angles, for example 30-45 degrees. The spring finger ring 33 may further be formed as a snap ring with a plurality of deflectable bumps and or protrusions, each bump functioning as an outward projecting spring finger 35. The spring finger ring 33 may be machined, stamped, formed, and or injection molded (of a conductive material or later given a conductive coating).

The invention provides a simplified and cost effective connector interface for use with existing standard threaded connectors. The invention allows a user to quickly connect and disconnect interconnections without time consuming threading and or additional tools. Further, the invention provides multiple bias points and connection surfaces that create a secure mechanical and high quality electrical interconnection. Additional electrical shielding is also provided by the first spring multiple bias points and connection surfaces, further isolating the interconnection from high frequency signal leakage and or interference.

Table of Parts

| | |
|---|---|
| 1 | female connector body |
| 3 | threads |
| 5 | male connector body |
| 7 | outer spring finger(s) |
| 9 | angled face |
| 11 | sleeve |
| 13 | shoulder |
| 15 | leading edge |
| 16 | bore |
| 17 | first groove |
| 19 | first spring |

-continued

| Table of Parts | |
|---|---|
| 21 | insulator |
| 23 | inner conductor contact |
| 25 | coaxial cable attachment area |
| 27 | second groove |
| 29 | second spring |
| 31 | third groove |
| 33 | spring finger ring |
| 35 | spring finger |
| 37 | collar |
| 39 | leading edge |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A connector interface for connecting to a cylindrical female connector body having an outer diameter surface and a bore with an inner diameter surface, comprising:

a monolithic male connector body with a plurality of integral outer spring fingers biased, via an inward projection of the spring fingers, for an interference fit upon the outer diameter surface;

a front end portion of a sleeve of the male connector body adapted to insert within the bore; and a first spring located on an outer diameter of the sleeve;

the first spring dimensioned for direct contact between the inner diameter surface of the bore and the outer diameter of the sleeve.

2. The connector interface of claim 1, wherein the first spring contacts the inner diameter surface upon mating of the male connector body with the female connector body.

3. The connector interface of claim 1, wherein the first spring is located by a first groove formed in the outer diameter of the sleeve.

4. The connector interface of claim 1, wherein the first spring is a canted coil spring.

5. The connector interface of claim 1, wherein the first spring is a ring having a plurality of deflectable protrusions.

6. The connector interface of claim 1, wherein the first spring is dimensioned whereby the first spring elastically deforms between the sleeve and the inner diameter surface upon mating of the male connector body with the female connector body.

7. The connector interface of claim 1, further including a second groove located around the plurality of outer spring fingers; and a second spring positioned in the second groove biasing the plurality of outer spring fingers inward.

8. The connector interface of claim 1, wherein the female connector is one of an SMA and a Type N connector.

9. The connector interface of claim 1, wherein the female connector has a third groove located on the inner diameter surface; the third groove adapted to align with the first groove when the male connector body is seated against the female connector.

10. The connector interface of claim 1, wherein the female connector has a third groove located on the inner diameter surface; the third groove adapted to receive an inner diameter contacting portion of the first spring when the male connector body is seated against the female connector.

11. The connector interface of claim 1, further including an inner conductor contact positioned coaxially within a sleeve bore by an insulator.

12. The connector interface of claim 1, wherein each of the plurality of outer spring fingers has an angled face.

13. The connector interface of claim 1, wherein the first spring is a spring finger ring having a plurality of spring finger(s) projecting outward from a collar.

14. The connector interface of claim 13, wherein a radius is formed in a leading edge of each spring finger.

15. The connector interface of claim 13, wherein the collar is dimensioned for press-fit mounting to the outer diameter of the sleeve.

16. The connector interface of claim 1, wherein the sleeve is formed as a separate component press-fit into place within the male connector body.

17. The connector interface of claim 16, wherein the sleeve is press-fit within the male connector body up to an internally projecting shoulder of the male connector body.

18. A connector interface between a female connector with an outer diameter surface and a bore with an inner diameter surface and a male connector, comprising:

a plurality of outer spring fingers formed in a leading edge of a monolithic male connector body of the male connector; and a first spring electrically coupled to the male connector;

the plurality of outer spring fingers biased, via an inward projection of the spring fingers, to engage an outer diameter surface of the female connector;

the first spring biased to directly contact the inner diameter surface of the bore.

19. The connector interface of claim 18, wherein the first spring is located by a first groove formed in an outer diameter of a sleeve within the male connector.

20. The connector interface of claim 18, wherein the first spring has a plurality of deflectable protrusions.

21. The connector interface of claim 18, wherein the first spring has a plurality of spring fingers.

22. The connector interface of claim 18, wherein a third groove adapted to engage the first spring is located on the inner diameter surface of the bore.

23. The connector interface of claim 18, wherein the female connector is one of an SMA and a Type N connector.

24. The connector interface of claim 18, further including a second groove located on an outer diameter of the male connector, around the plurality of outer spring fingers.

25. The connector interface of claim 24, further including a second spring seated in the second groove; the second spring further biasing the outer spring fingers towards the outer diameter surface of the female connector.

* * * * *